US008376247B2

(12) United States Patent
Manthey et al.

(10) Patent No.: US 8,376,247 B2
(45) Date of Patent: Feb. 19, 2013

(54) EXTINGUISHING FIRES AND SUPPRESSING EXPLOSIONS

(75) Inventors: Christian Manthey, Duisburg (DE); Hans-Joachim Herzog, Oschersleben (DE); Robert George Dunster, Slough (GB)

(73) Assignee: Kidde IP Holdings Limited (GB)

( * ) Notice: Subject to any disclaimer, the term of this patent is extended or adjusted under 35 U.S.C. 154(b) by 0 days.

(21) Appl. No.: 12/910,498

(22) Filed: Oct. 22, 2010

(65) Prior Publication Data

US 2011/0036599 A1 Feb. 17, 2011

Related U.S. Application Data

(62) Division of application No. 11/440,598, filed on May 24, 2006, now Pat. No. 7,841,419.

(30) Foreign Application Priority Data

May 26, 2005 (GB) ..... 0510773.5
Mar. 6, 2006 (GB) ..... 0604499.4

(51) Int. Cl.
*B05B 1/34* (2006.01)
*A62C 35/00* (2006.01)

(52) U.S. Cl. ..... 239/489; 239/463; 239/474; 239/475; 239/487; 169/14

(58) Field of Classification Search ..... 169/6, 11, 169/12, 14, 37, 44; 239/418, 422, 423, 424, 239/425, 428, 434.5, 440, 558, 560, 561, 239/463, 466, 472, 474, 475, 487, 488, 489
See application file for complete search history.

(56) References Cited

U.S. PATENT DOCUMENTS

| | | | | |
|---|---|---|---|---|
| 625,466 | A * | 5/1899 | Randolph | 239/472 |
| 822,546 | A | 6/1906 | Newman | |
| 1,405,831 | A | 2/1922 | Fricker | |
| 1,895,890 | A | 1/1933 | Meng | |
| 4,800,961 | A * | 1/1989 | Klein | 169/37 |
| 5,678,637 | A | 10/1997 | O'Connell | |
| 6,814,150 | B2 * | 11/2004 | Clauss et al. | 169/7 |
| 2004/0251320 | A1 * | 12/2004 | Koponen | 239/434.5 |

(Continued)

FOREIGN PATENT DOCUMENTS

| | | | |
|---|---|---|---|
| DE | 94 15 124.5 | U1 | 12/1994 |
| DE | 199 34 920 | C1 | 12/2000 |

(Continued)

OTHER PUBLICATIONS

European Search Report mailed Apr. 3, 2008.

(Continued)

*Primary Examiner* — Ryan Reis
(74) *Attorney, Agent, or Firm* — Merchant & Gould P.C.

(57) ABSTRACT

A fire extinguishing or explosion suppression device comprises a chamber and a nozzle. The nozzle defines a discharge pathway from the chamber. The chamber has an inlet for pressure-driven introduction of a liquid into the chamber. The chamber is shaped so that a gas contained in the chamber before the introduction of the liquid is entrained into the liquid during the pressure driven introduction of the liquid such that a mixture of the liquid and the gas is discharged through the nozzle to create a mist for extinguishing a fire or suppression of an explosion. After the gas has been discharged from the chamber, the nozzle produces a spray having a core of larger liquid droplets with the core being surrounded by smaller liquid droplets.

16 Claims, 12 Drawing Sheets

U.S. PATENT DOCUMENTS

| | | | | |
|---|---|---|---|---|
| 2005/0011652 | A1* | 1/2005 | Hua | 169/37 |
| 2005/0139364 | A1* | 6/2005 | Dushkin et al. | 169/37 |

FOREIGN PATENT DOCUMENTS

| | | | |
|---|---|---|---|
| DE | 201 14 923 | U1 | 3/2002 |
| EP | 0 314 354 | A1 | 5/1989 |
| EP | 0 671 216 | A2 | 9/1995 |
| FR | 502.777 | | 5/1920 |
| FR | 2 808 227 | | 11/2001 |
| GB | 559935 | | 3/1944 |
| GB | 2 395 660 | A | 6/2004 |
| JP | 2002-369892 | | 12/2002 |
| SU | 1224002 | A | 4/1986 |
| WO | WO 92/20454 | | 11/1992 |
| WO | WO 01/05468 | A2 | 1/2001 |

OTHER PUBLICATIONS

European Search Report mailed Aug. 28, 2008.

European Search Report dated Oct. 26, 2010 for corresponding European application EP 10175778 (5 pages).

Claims from corresponding European Application No. 10 175 778.9 (2 pages).

European Examination Report cited in corresponding Application No. 10 175 778.9 mailed Jul. 18, 2011 (3 pages).

* cited by examiner

Date 4/5/05
Fuel: 1.1L Diesel
Pressure: 82.7 bar(g) 1200 psig
Fuel Distribution: ATC nozzle
Ignition time delay = 90 ms
1 x 5KJ sobbe ignition Suppressor time delay = 11 ms
Suppressors: 3 x 2.9 L
2L Water + Potassium Lactate
50% by mass and 50 bar(g) N2
Note: 4 Mannequins installed $P_{red}$ = 0.085 bar(g)
$P_{red}$ = 1.23 psig
$K_{max}$ = 2.56 bar.m.s$^{-1}$
$T_{red}$ = 110 ms
Vent not ruptured

A – A

EXTINGUISHING FIRES AND SUPPRESSING EXPLOSIONS

This application is a divisional of application Ser. No. 11/440,598, filed May 24, 2006, which application is incorporated herein by reference in its entirety.

The invention relates to a device and a method for extinguishing fires and/or for suppressing explosions, and also to a nozzle for producing a spray of liquid.

A known device for extinguishing fires and suppressing explosions comprises a chamber and a nozzle defining a discharge pathway from the chamber. The chamber has an inlet for the pressure driven introduction of a liquid into the chamber. In use, liquid is introduced into the chamber, usually driven by a compressed gas, and the liquid is subsequently discharged through the nozzle so as to produce a spray of liquid droplets. The spray acts to extinguish the fire or suppress the explosion. Generally, before the device is activated by introduction of the liquid into the chamber, the chamber contains air, and this gives rise to a problem associated with this known device. Specifically, when the device is activated by introduction of the liquid into the chamber, the air is driven through the nozzle before the liquid. This is undesirable because the expelled air contains oxygen which feeds the fire or the explosion before any water droplets are sprayed from the nozzle.

In accordance with a first aspect of the invention, there is provided a fire extinguishing or explosion suppression device comprising, a chamber and a nozzle defining a discharge pathway from the chamber, the chamber having an inlet for pressure-driven introduction of a liquid into the chamber, the chamber being shaped so that a gas contained in the chamber before the introduction of the liquid is entrained into the liquid during the pressure driven introduction of the liquid such that a mixture of the liquid and the gas is discharged through the nozzle to create a mist for extinguishing a fire or suppression of an explosion.

In accordance with a second aspect of the invention, there is provided a method of extinguishing a fire or suppressing an explosion, comprising providing a chamber containing a gas, forcing a liquid into the chamber, the chamber being shaped so that the gas becomes entrained within the liquid as the liquid is forced into the chamber to produce a mixture of the gas and the liquid, discharging the mixture of the gas and the liquid through a nozzle to produce a mist for extinguishing a fire or suppressing an explosion.

Accordingly, the first and second aspects of the invention may allow a reduction or elimination in discharge of air alone from the device.

Nozzles known for suppressing explosions or extinguishing fires tend to produce sprays which are homogenous in terms of droplet size distribution. Another known type of nozzle produces a spray having a core consisting of relatively small liquid droplets, the core being surrounded by relatively large liquid droplets.

In accordance with a third aspect of the invention, there is provided a nozzle for producing a spray of liquid, the spray having a core of larger liquid droplets and the core being surrounded by smaller liquid droplets.

Nozzles in accordance with this aspect of the invention may be particularly effective at suppressing explosions and extinguishing fires.

In accordance with a fourth aspect of the invention, there is provided a fire extinguishing or explosion suppressing device in accordance with the first aspect of the invention, wherein the or each nozzle is in accordance with the third aspect of the invention.

Such a combination may be particularly effective at suppressing explosions.

In accordance with a fifth aspect of the invention, there is provided a method of extinguishing a fire or suppressing an explosion, comprising directing a liquid spray at the fire or explosion, the spray having a core of large liquid droplets and the core being surrounded by smaller liquid droplets.

As used herein the terms "extinguish" and "extinguishing" include the case where a fire is only partially extinguished.

The following is a more detailed description of embodiments of the invention, by way of example only, reference being made to the accompanying drawings in which.

Figure 2:
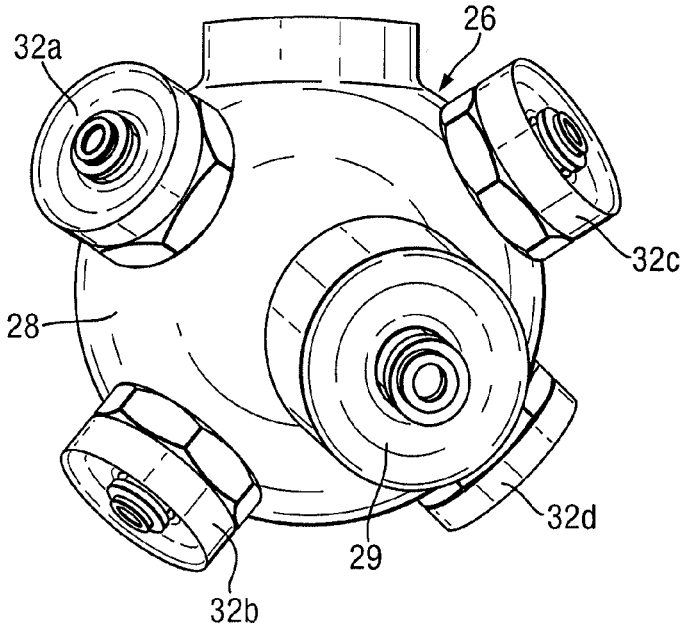
FIG. 2 is a front perspective view of a discharge head of the explosion suppression system shown in FIG. 1.
Figure 6A:
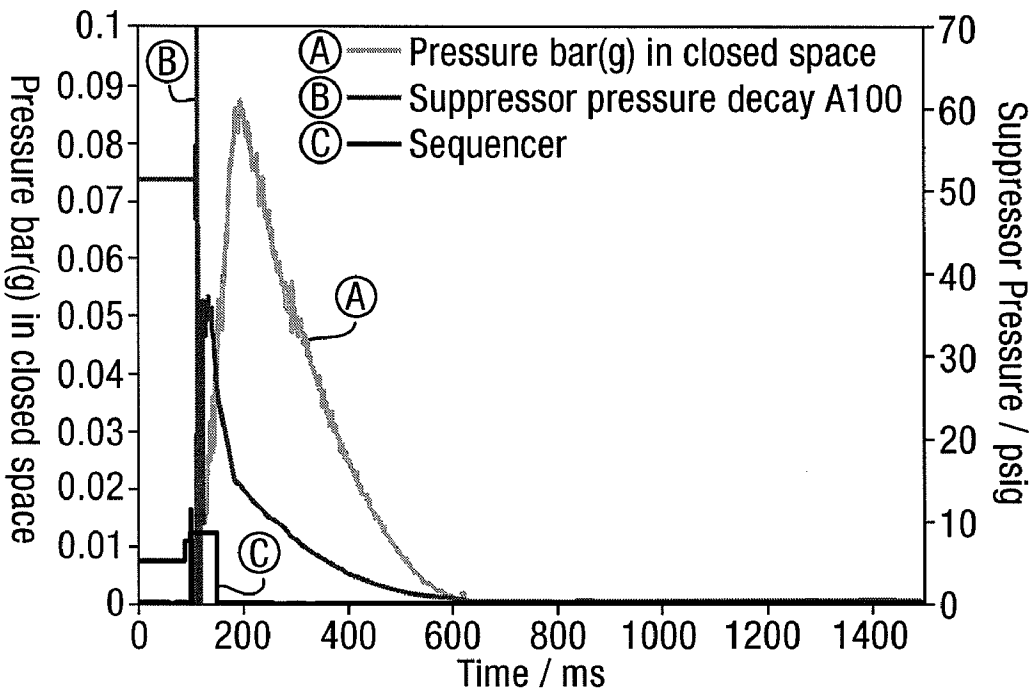
Figure 6B:
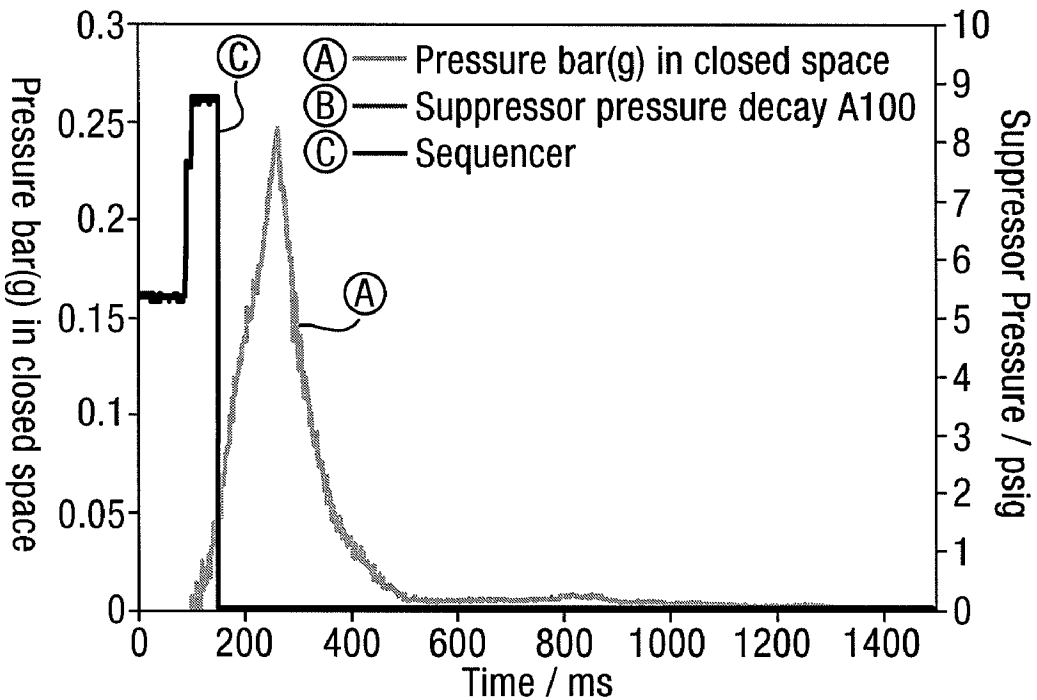
Figure 7A:
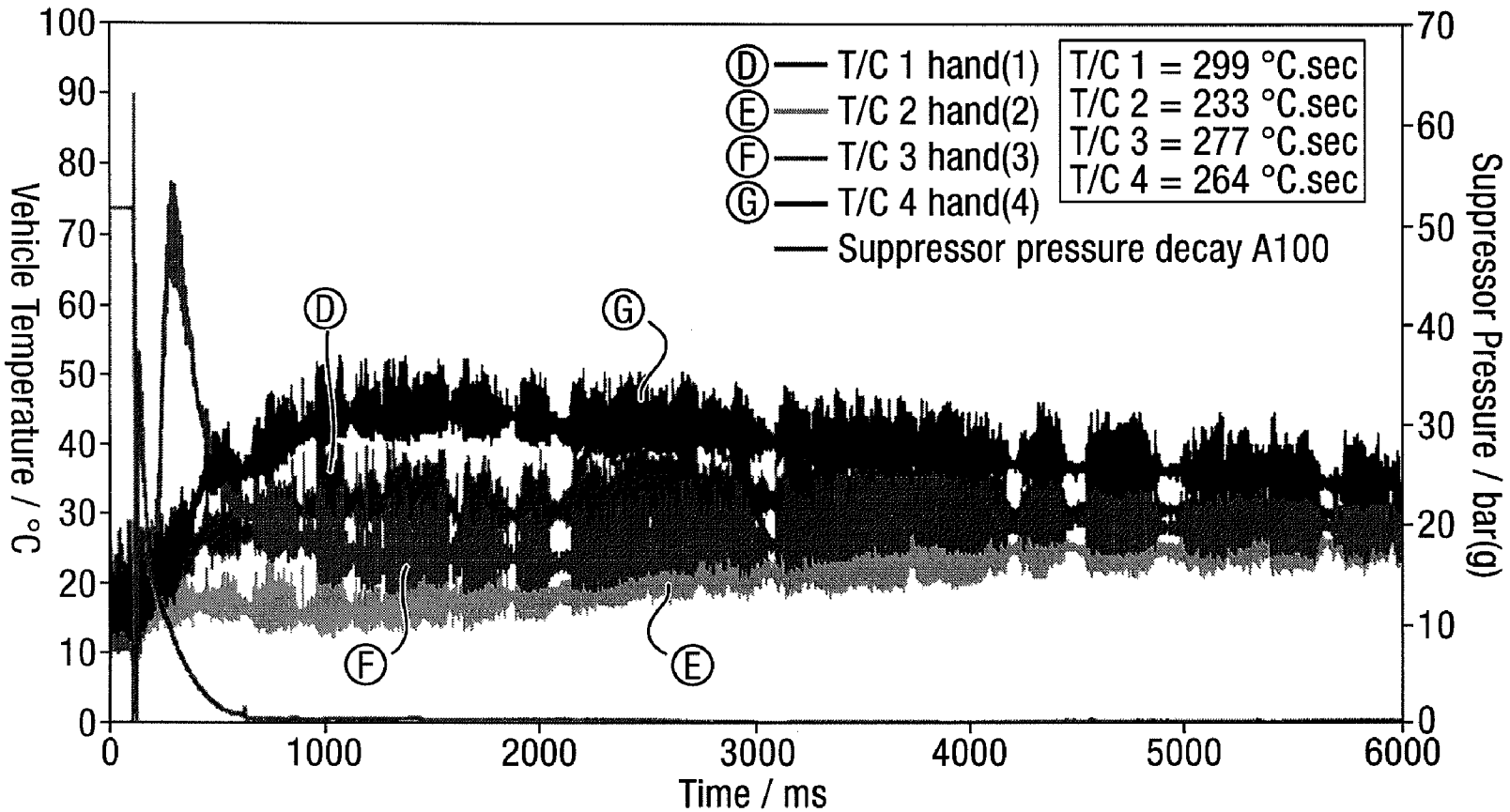
Figure 7B:
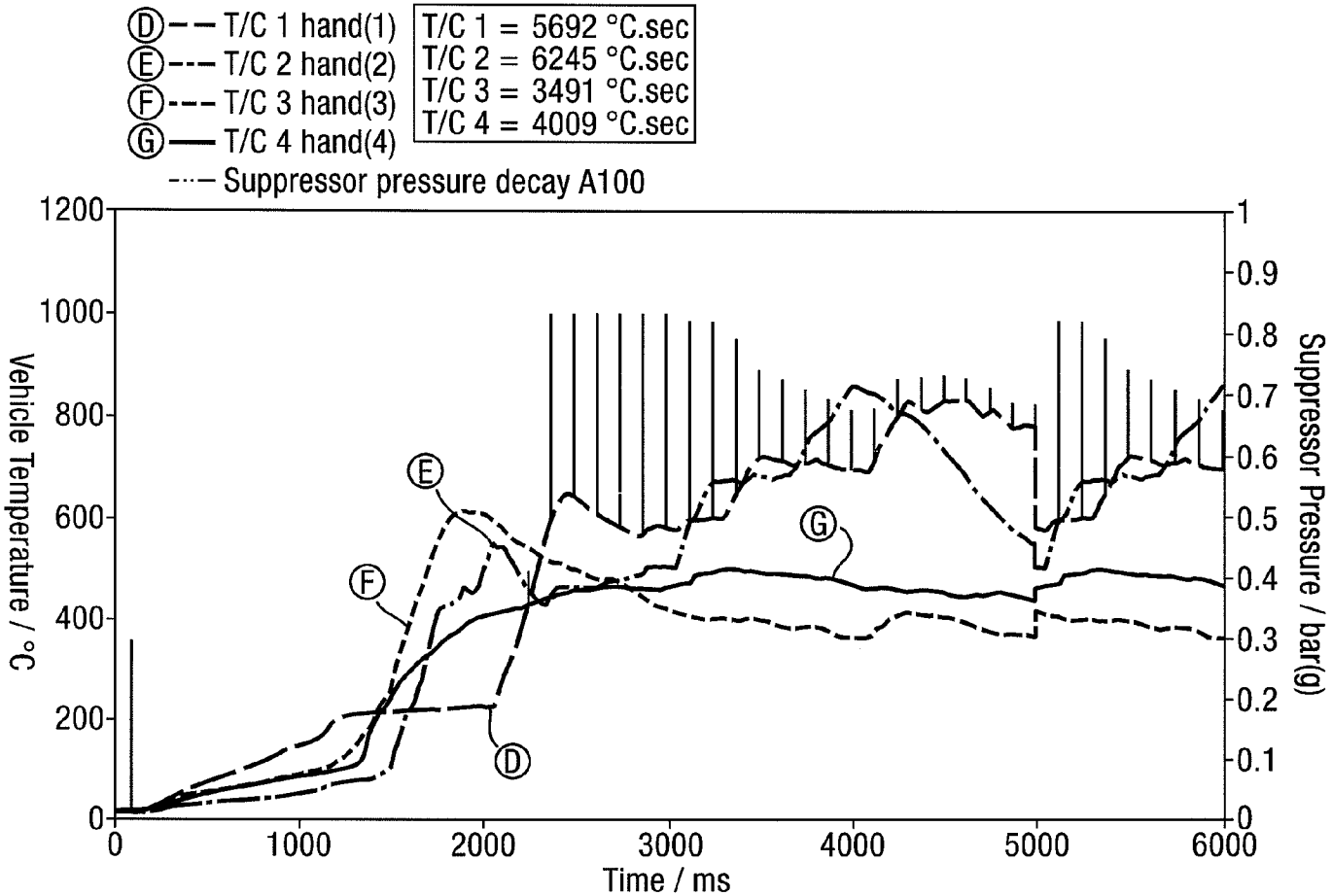
Figure 8:
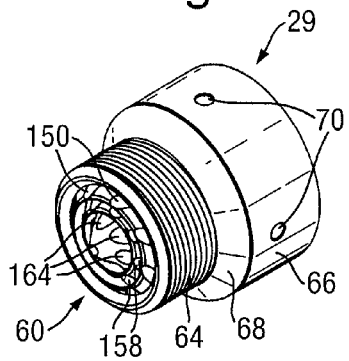
Figure 9:
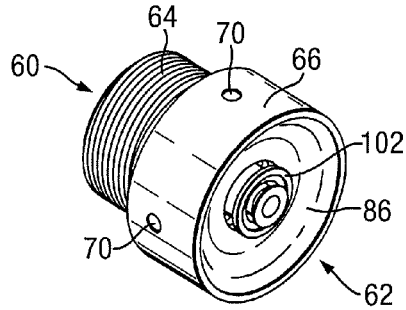
Figure 10:
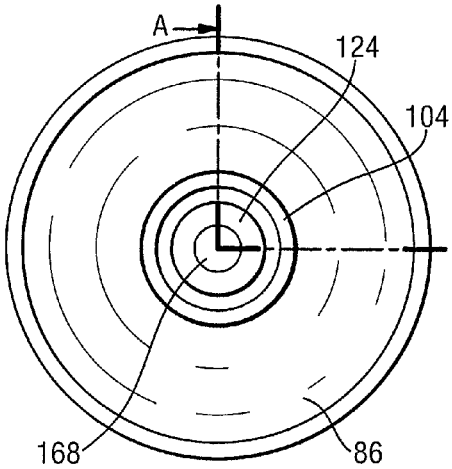
Figure 11:
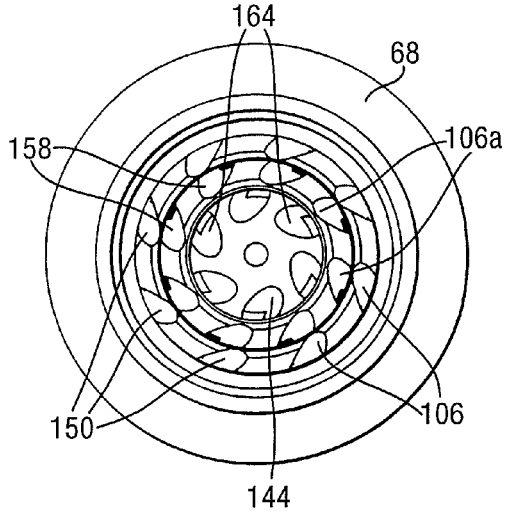
Figure 12:
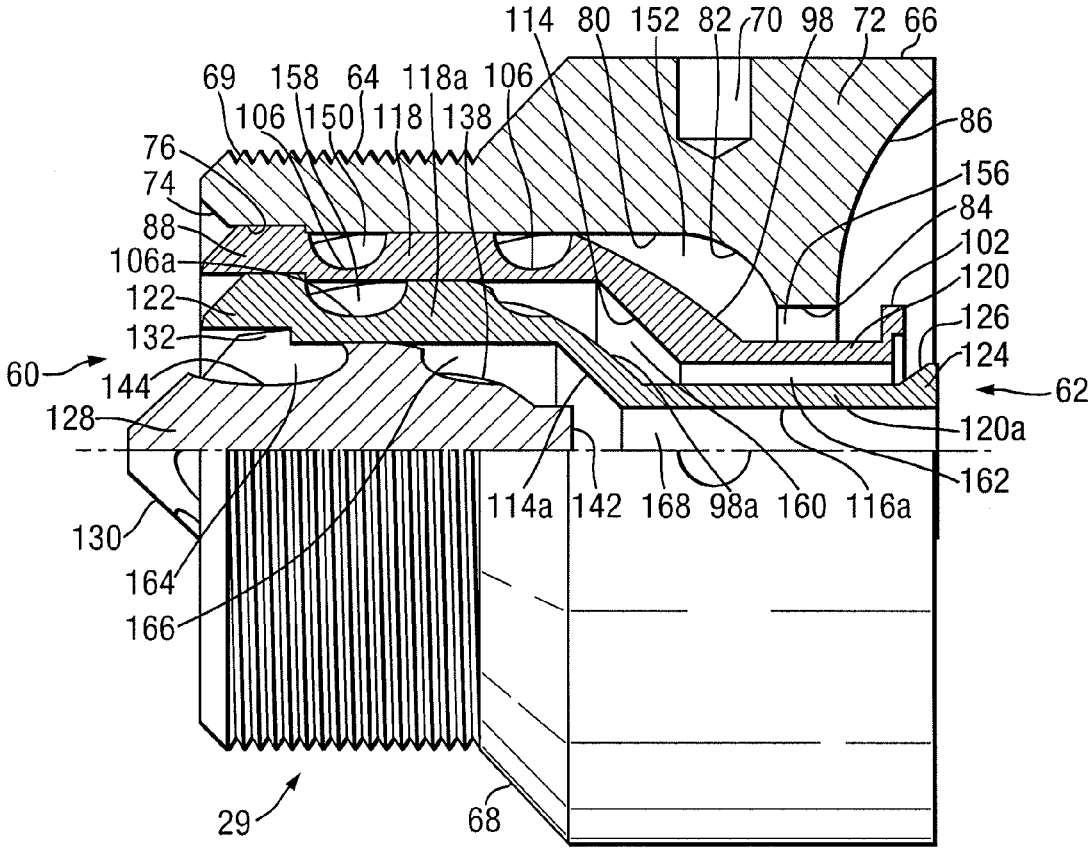
Figure 13:
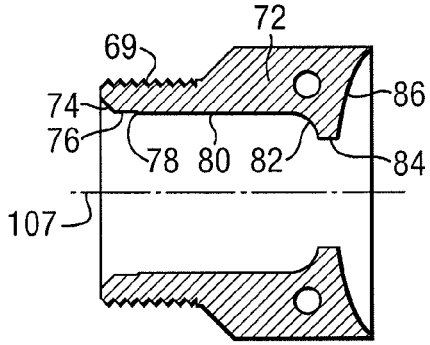
Figure 14A:
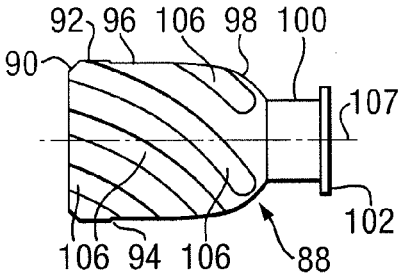
Figure 14B:
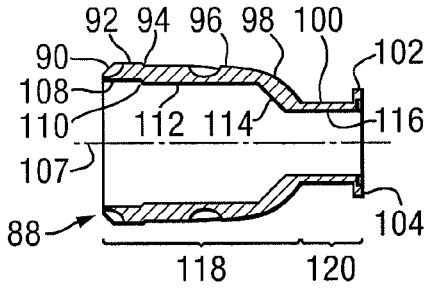

FIGS. 6*a* and 6*b* show pressure within a closed space during simulated explosions;

FIGS. 7*a* and 7*b* show temperature within the closed space during simulated explosions;

FIG. 8 is a schematic perspective view of a large nozzle of the discharge head of FIG. 2 showing an inlet end of the nozzle;

FIG. 9 is a schematic perspective view of the nozzle of FIG. 8 showing an outlet end of the nozzle;

FIG. 10 is a schematic elevation showing the outlet end of the nozzle;

FIG. 11 is a schematic elevation showing the inlet end of the nozzle;

FIG. 12 is a schematic view, partially in cross-section, showing the nozzle;

FIG. 13 is a schematic cross-sectional view of a casing forming part of the nozzle;

FIG. 14*a* is a schematic side elevation showing an outer annular insert forming part of the nozzle;

FIG. 14*b* is a schematic cross-sectional view of the outer annular insert of FIG. 14*a;*

Figure 14C:
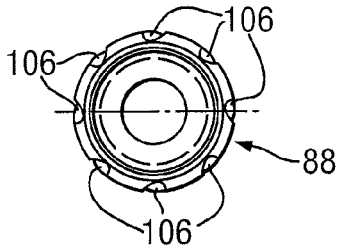

FIG. 14*c* is a schematic end elevation of the outer annular insert of FIG. 14*a;*

Figure 15A:
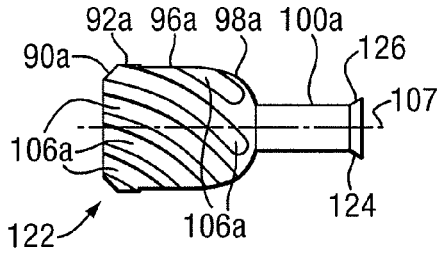
Figure 15B:
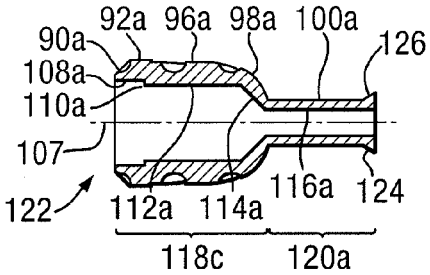

FIG. 15*a* is a schematic side elevation of an inner annular insert forming part of the nozzle;

FIG. 15*b* is a schematic cross-sectional representation of the inner annular insert of FIG. 15*a;*

Figure 15C:
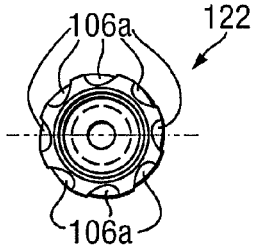

FIG. 15*c* is a schematic end elevation of the inner annular insert of FIG. 15*a;*

Figure 16A:
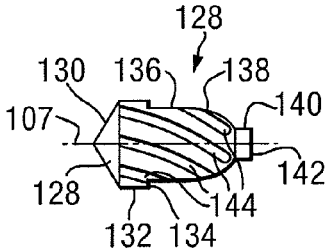
Figure 16B:
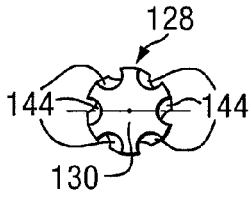

FIG. 16*a* is a schematic side elevation of an inner insert forming part of the nozzle;

FIG. 16*b* is a schematic side elevation of the inner insert of FIG. 16*a;*

Figure 17:
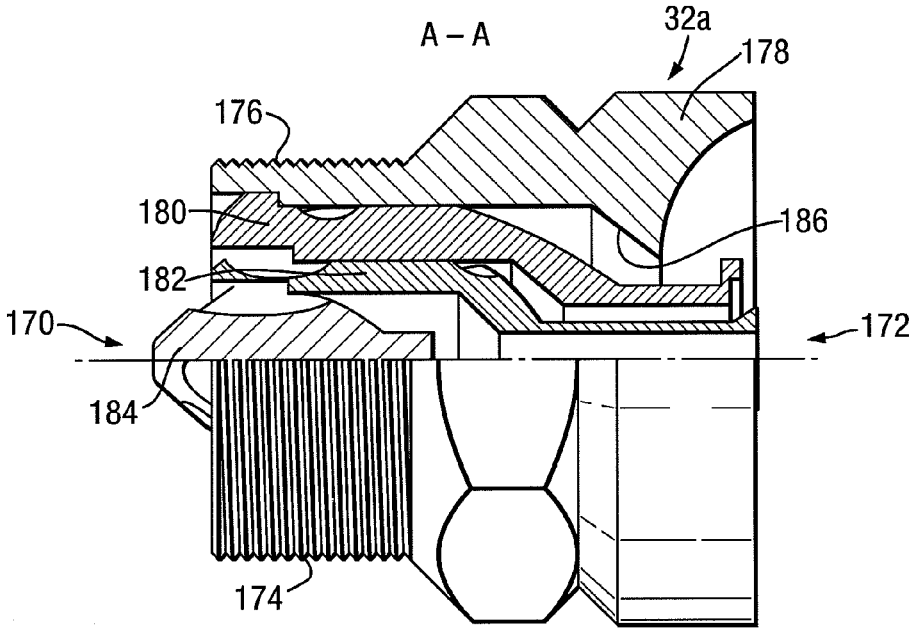
Figure 18:
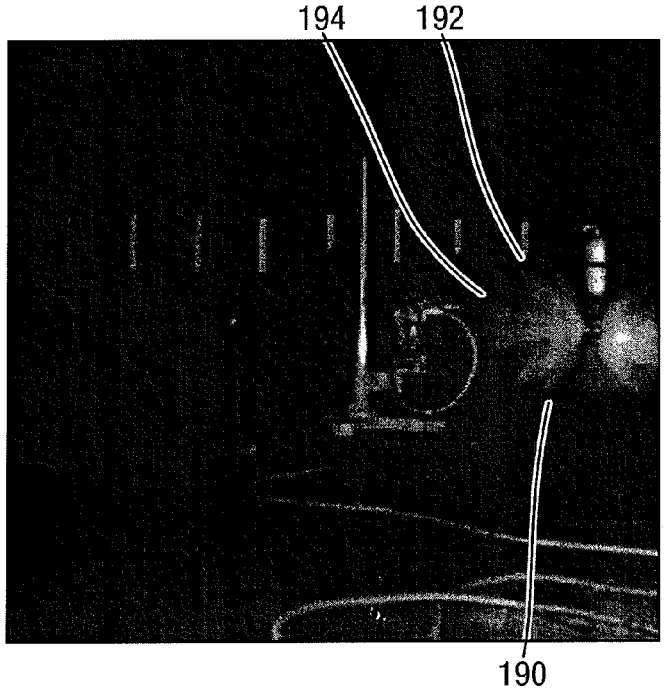

FIG. 17 is a schematic representation, partially in cross-section, showing a small nozzle which forms part of the discharge head of FIG. 2; and FIG. 18 is a photograph showing a conical liquid spray produced by the large nozzle shown in FIGS. 8 to 12.

The explosion suppression system shown in FIGS. 1 to 4 may be deployed in a closed space in which there is a risk of an explosion taking place. The enclosed space may be, for example, in a vehicle.

Figure 1:
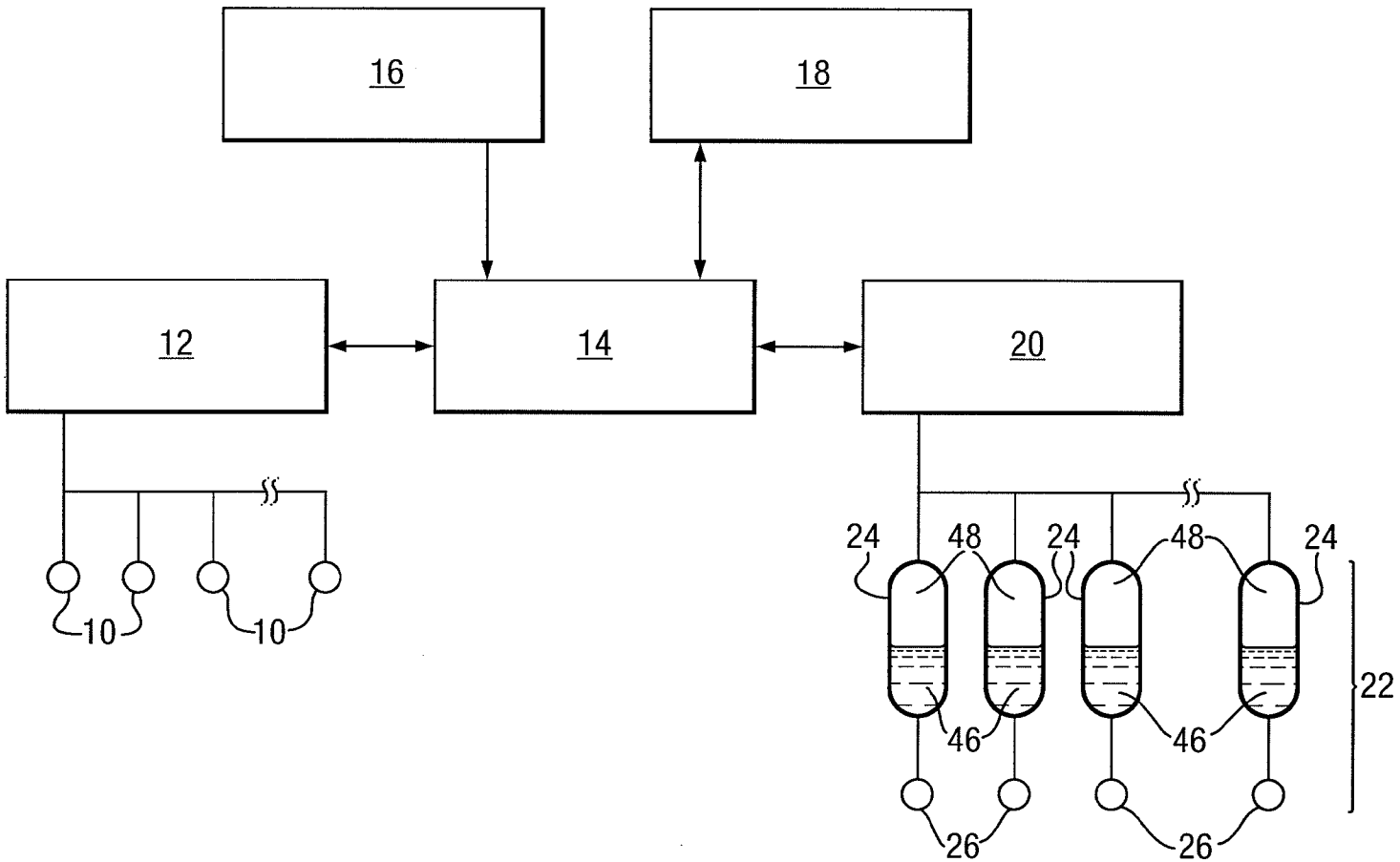
FIG. 1 is a schematic representation of various components of an explosion suppression system.

Referring first to FIG. 1, the explosion suppression system comprises a plurality of explosion sensors 10 which may be, for example, infrared sensors of known type. The explosion sensors 10 are sited at different locations within the closed space (not shown). Each explosion sensor 10 is connected via a detection unit 12 to a control unit 14. The explosion suppression system also includes a power supply 16 which is connected to the control unit 14 and an information display 18 which is also connected to the control unit 14. The control unit 14 is connected to a plurality of extinguishers 22 via an extinguisher unit 20. The extinguishers 22 are also sited at different locations within the closed space (not shown).

In operation, if one or more of the explosion sensors 10 detect an explosion, a signal is sent via the detection unit 12 to the control unit 14. In turn, the control unit 14 passes a signal to the extinguisher unit 20 which activates all of the extinguishers 22 to discharge liquid mist into the closed space.

Apart from the extinguishers 22, all of the components of the explosion suppression system are well know. Each extinguisher 22 consists of a liquid container 24 and a discharge head 26 which will now be described in greater detail.

Figure 3:
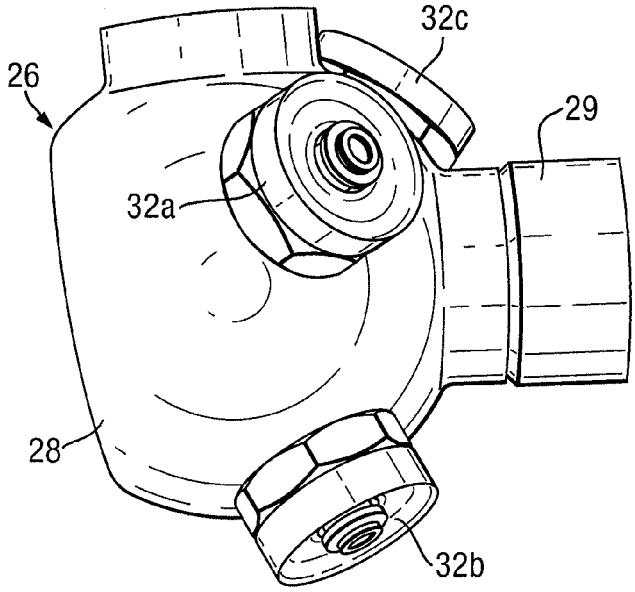
FIG. 3 is a side perspective view of the discharge head of FIG. 2.
Figure 4:
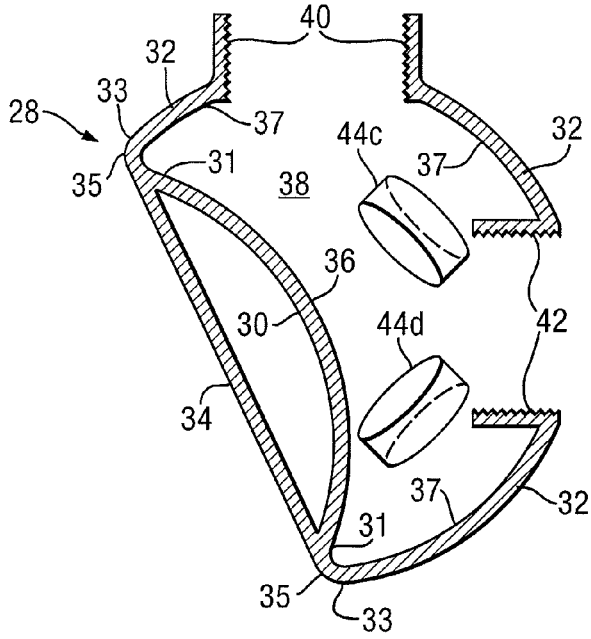
FIG. 4 is a schematic cross-sectional representation of a discharge chamber body which is part of the discharge head shown in FIGS. 2 and 3.

As shown in FIGS. 2 to 4, each discharge head 26 comprises a discharge chamber body 28, one large nozzle 29 and four small nozzles 32*a* to 32*d*. There is a valve (not shown) between the liquid container 24 and the discharge head 26. The purpose of this is described below.

As best seen in FIG. 4, the discharge chamber body 28 is formed from a first wall 30 which has the form of a part of a sphere, a second wall 32 which also has the form of a part of a sphere and a planar wall 34 which is generally circular in shape. Referring still to FIG. 4, the first wall 30 has an annular edge 31 which is welded to the planar wall 34 adjacent an outer edge 35 of the planar wall 34. An annular edge 33 of the second wall 32 is welded to the outer edge 35 of the planar wall 34, so that the first wall 30 lies between the planar wall 34 and the second wall 32 and extends into the space surrounded by the second wall 32.

Importantly, as shown in FIG. 4, the convex surface 36 of the first wall 30 together with the concave inner surface 37 of the second wall 32 enclose a space or chamber 38. The convex surface 36 of the first wall 30 is purposely roughened, and the concave surface 37 of the second wall 32 is also purposely roughened. This roughening serves a purpose described below.

The discharge chamber body 28 also has an inlet 40 in the form of an annular flange which extends upwardly from the second wall 32 and which opens into the chamber 38. The inlet 40 is threaded on the inside for connection to the corresponding liquid container 24 so that liquid from the container 24 can be introduced into the chamber 38 through the inlet 40.

Remaining with FIG. 4, the discharge chamber body 28 also has a large outlet mount 42 in the form of an annular flange which extends horizontally inwardly from the second wall 32 and which opens into the chamber 38. The large outlet mount 42 is internally threaded to receive the large nozzle 29 shown in FIGS. 2 and 3 and in FIGS. 8-16.

Finally, the discharge chamber body 28 also has four small outlet mounts, two of which are shown in FIG. 4, behind the cross-sectional plane, at 44*c* and 44*d*. The four small outlet mounts 44*c* and 44*d* also take the form of annular flanges, similar to the large outlet mount 42, and extend inwardly from the second wall 32 and open into the chamber 38. Each small outlet mount 44*c*, 44*d* is internally threaded to receive a respective one of the four small nozzles 32*a* to 32*d* (which are shown in FIGS. 2, 3 and 17).

As best seen in FIG. 2, the four small outlet mounts 44*c*, 44*d*, and the four small nozzles 32*a* to 32*d* are spaced from one another around the large outlet mount 42 and the large nozzle 29. As the second wall 32 has the shape of part of a sphere, and as shown in FIGS. 2 and 3, the nozzles are directed in different directions from one another. Specifically, each nozzle directs its respective discharge in a direction which is perpendicular to a plane touching the second wall 32 tangentially at the corresponding mount 42, 44*c*, 44*d* in which the nozzle is fixed.

For the avoidance of any doubt, the space between the first wall 30 and the planar wall 34 is a closed space and plays no part in the operation of the current invention.

Each discharge head 26 is connected via its inlet 40 to a respective one of the liquid containers 24 via a respective valve (not shown) which is operated by the extinguisher unit 20. Each liquid container 24 contains a liquid 46 lying underneath a pressurized gas 48. The liquid containers 24 are of known construction.

The large nozzle 29 is best seen in FIGS. 8 to 12. The large nozzle 29 has an inlet end 60, best seen in FIGS. 8 and 11, and an outlet end 62, best seen in FIGS. 9 and 10. The large nozzle 29 has a narrow portion 64 located adjacent the inlet end 60 and a wide portion 66 located adjacent the outlet end 62. The narrow portion 64 and the wide portion 66 are connected by a step 68. The narrow portion 64 is provided with an external thread (shown at 69 in FIG. 12) by which the large nozzle 29 can be threadably mounted into the large outlet mount 42. The wide portion 66 is provided with a plurality of blind holes 70 by which purchase can be provided, using a suitable tool, for threading the large nozzle 29 into the large outlet mount 42.

The large nozzle 29 is formed from four parts which are concentric around an axis 107 and which are best seen in FIGS. 12 to 16.

The radially outermost one of these parts is a casing 72 shown in FIGS. 12 and 13. The casing 72 provides the external thread 69 on the narrow portion 64 and the blind holes 70 in the wide portion 66. The annular casing 72 has an internal surface which, starting from the inlet end 60 of the large nozzle 29, has a bevelled portion 74 which leads to a recess portion 76. The recess portion 76 is connected by a step portion 78 to a first cylindrical portion 80 which lies radially inwardly of the recess portion 76. The first cylindrical portion 80 is connected by a curved portion 82 to a second cylindrical portion 84 which lies radially inwardly of the first cylindrical portion 80. At the outlet end 62 of the large nozzle 29, the casing 72 has a concave surface 86 which faces generally outwardly in the axial sense.

An outer annular insert 88 is shown in FIGS. 14*a* to 14*c* and, as best seen in FIG. 12, fits closely within the casing 72. The outer annular insert 88 has an outer surface which, starting from the inlet end 60 of the large nozzle 29 has a bevelled portion 90 which extends to a flange portion 92. The flange portion 92 is connected by a step portion 94 to a first cylindrical portion 96 which lies radially inwardly of the flange portion 92. The first cylindrical portion 96 joins a curved portion 98 which extends to a second cylindrical portion 100, which lies radially inwardly of the first cylindrical portion 96. At the outlet end 62 of the large nozzle 29, an annular wall 102 extends radially outwardly from the second cylindrical portion 100. The annular wall 102 is provided, at its radially outer edge, with an annular rib 104 which extends outwardly in the axial direction.

Eight grooves 106 are cut into the outer surface of the outer annular insert 88 (see FIGS. 14*a* and 14*c*). As best seen in FIG. 14*a*, each one of the grooves 106 extends from the inlet end 60 of the large nozzle 29 to the curved portion 98 of the outer surface of the outer annular insert 88. Additionally, each groove 106 is curved so that it extends angularly around the axis 107 while extending simultaneously generally in the axial direction. Further, as each groove 106 extends from the inlet end 60 of the large nozzle 29 towards the outlet end 62, the angular extension of the groove around the axis 107 for a given unit length in the axial direction increases progressively. In other words, each groove 106 might be considered in general terms to form a part spiral, the pitch of the spiral increasing as the groove 106 extends from the inlet end 60 towards the outlet end 62. To express this in yet a further manner, it might be said that the angle made by each groove 106 relative to the axis 107 increases progressively as the groove 106 extends from the inlet end 60 to the outlet end 62. The surfaces of the grooves 106 may be roughened for a purpose described below.

Looking now at FIG. 14*b*, the outer annular insert 88 has an inner surface which is made up of, starting from the inlet end 60 of the large nozzle 29, a recess portion 108 which is connected by a step portion 110 to a first cylindrical portion 112, such that the first cylindrical portion 112 lies radially inwardly of the recess portion 108. The first cylindrical portion 112 is connected by a frusto-conical portion 114 to a second cylindrical portion 116 which lies radially inwardly of the first cylindrical portion 112.

Accordingly, as best seen in FIG. 14*b*, the outer annular insert 88 may be considered to have a body portion 118 and a tubular portion 120. The body portion 118 is located next to the inlet end 60 of the large nozzle 29 and provides the bevelled portion 90, the flange portion 92, the step portion 94, the first cylindrical portion 96 and the curved portion 98 of the outer surface. The body portion 118 also provides the recess portion 108, the step portion 110, the first cylindrical portion 112 and the frusto-conical portion 114 of the inner surface of the outer annular insert 88. The tubular portion 120 is located next to the outlet end 62 of the large nozzle 29 and provides the second cylindrical portion 100 of the outer surface and the second cylindrical portion 116 of the inner surface. The annular wall 102 extends from the outer end of the tubular portion 120.

Referring now to FIGS. 12 and 15*a* to 15*c*, an inner annular insert 122 lies closely within the outer annular insert 88. The inner annular insert 122 is similar in shape to the outer annular insert 88 and so, with the exception of those parts which differ, will not be described in detail. Features of the inner annular insert 122 which correspond to similar features of the outlet annular insert 88 will be given corresponding reference numerals ending in the suffix a. The differences between the inner annular insert 122 and the outer annular insert 88 are as follows.

Firstly, the inner annular insert 122 is radially smaller than the outer annular insert 88 so that the inner annular 122 can fit within the outer annular insert 88. Further, the body portion 118*a* of the inner annular insert 122 is shorter in the axial direction than the body portion 118 of the outer annular insert 88, so that the body portion 118*a* of the inner annular insert 122 can fit within the body portion 118 of the outer annular insert 88. Also, the tubular portion 120*a* of the inner annular insert 122 is longer and narrower than the tubular portion 120 of the outer annular insert 88, so that the tubular portion 120*a* of the inner annular insert 122 can extend through the tubular portion 120 of the outer annular insert 88. The manner in which the inner annular insert 122 fits within the outer annular insert 88 is best shown in FIG. 12.

The inner annular insert 122 does not have an annular wall similar to the annular wall 102 of the outer annular insert 88. Instead, the outer end of the tubular portion 120*a* of the inner annular insert 122 is provided with a radially outwardly directed annular flange 124. The annular flange 124 has a frusto-conical surface 126 which extends radially and axially outwards from the tubular portion 120*a* of the inner annular insert 122.

Finally, the grooves 106*a* provided in the outer surface of the body portion 118*a* of the inner annular insert 122 are similar to the grooves 106 of the outer annular insert 88. However, the grooves 106*a* of the inner annular insert 122 differ in two respects from the grooves 106 of the outer annular insert 88. Firstly, the grooves 106*a* of the inner annular insert 122 are deeper, in the radial direction, as compared to the grooves 106 of the outer annular insert 88. Secondly, at the ends of the grooves 106, 106*a*, located towards the outlet end 62 of the large nozzle 29, the angular extension around the axis 107 for a given unit length in the axial direction of each groove 106*a* in the inner annular insert 122 is less than the corresponding angular extension of each groove 106 in the outer annular insert 88. In other words, at the ends of the grooves 106, 106*a* closest to the outlet end 62 of the large nozzle 29, the angle between the groove 106, 106*a*, relative to the axis 107, is less for the grooves 106*a* in the inner annular insert 122 as compared to the grooves 106 in the outer annular insert 88. The surfaces of the grooves 106*a* may be roughened for a purpose described below.

The last of the four concentric parts making up the nozzle 29 is shown in FIGS. 16*a* and 16*b*. This part will be referred to as the inner insert 128. The inner insert 128 is solid and generally symmetrical around the axis 107. The inner insert 128 has a surface which, starting from the inlet end 60 of the large nozzle 29 has a conical portion 130, leading to a flange portion 132. The flange portion 132 is connected by a step portion 134 to a first cylindrical portion 136, which lies radially inwardly of the flange portion 132. The first cylindrical portion 136 is connected by a curved portion 138 to a second cylindrical portion 140 which lies radially inwardly of the first cylindrical portion 136. The second cylindrical portion 140 connects with a radially extending end portion 142. Six grooves 144 are cut into the inner insert 128 and extend from the flange portion 132 of the surface to the curved portion 138 of the surface. The six grooves 144 are generally similar in shape to the grooves 106 of the outer annular insert 88 and the grooves 106*a* of the inner annular insert 122. However, the grooves 144 in the inner insert 128 are deeper, in a radial direction, as compared to the grooves 106*a* of the inner annular insert 122. Additionally, at the ends of the grooves 144, 106*a* located towards the outlet end 62 of the large nozzle 29, the angular extension around the axis 107 for a given unit length in the axial direction is less for the grooves 144 in the inner insert 128 as compared to the grooves 106*a* in the inner annular insert 122. In other words, at the ends of the grooves 144, 106*a*, located closer to the outlet end 62 of the nozzle 29, the angle between each groove 144, 106*a* relative to the axis 107 is less for the grooves 144 in the inner insert 128 as compared to the grooves 106*a* in the inner annular insert 122.

The manner in which the four concentric parts making up the large nozzle 29 fit together is best shown in FIG. 12. The flange portion 92 of the outer surface of the outer annular insert 88 lies within the recess portion 76 of the internal surface of the casing 72 so as to locate the outer annular insert 88 within the casing 72. As seen in FIG. 12, the first cylindrical portion 96 of the outer surface of the outer annular insert 88 lies in close contact with the first cylindrical portion 80 of the internal surface of the casing 72 so that the first cylindrical portion 80 of the internal surface of the casing 72 closes the grooves 106, provided in the outer annular insert 88, for the majority of their length. The grooves 106, when closed in this way, form eight radially outer channels 150 (see FIG. 11), which extend into the large nozzle 29 from the inlet end 60.

The radially outer channels 150 (formed between the casing 72 and the outer annular insert 88) open into a first annular space 152. The first annular space 152 is formed between, on one side, the curved portion 82 and part of the first cylindrical portion 80 of the internal surface of the casing 72, and, on the other side, the curved portion 98 and part of the second cylindrical surface 100 of the outer surface of the outer annular insert 88. The first annular space 152, at its end closest to the outlet end 62 of the large nozzle 29, opens into a first annular passageway 156 which is formed between the second cylindrical portion 84 of the internal surface of the casing 72 and the second cylindrical portion 100 of the outer surface of the outer annular insert 88.

In turn, the first annular passageway 156 then opens into a formation for directing droplets from the outlet end 62 of the large nozzle 29 at an acute angle from the axis 107. The droplet directing formation is formed by the axially outwardly facing concave surface 86 provided on the casing 72 together with the radially extending annular wall 102 provided on the outer annular insert 88. As shown in FIG. 12, the annular wall 102 is located generally axially outwardly of the concave surface 86.

The flange portion 92*a* of the outer surface of the inner annular insert 122 fits within the recess portion 108 of the inner surface of the outer annular insert 88 so as to locate the inner annular insert 122 within the outer annular insert 88. The first cylindrical portion 96*a* of the outer surface of the inner annular insert 122 fits closely within the first cylindrical portion 112 of the inner surface of the outer annular insert 88 so that the inner surface of the outer annular insert 88 closes the grooves 106*a* in the inner annular insert 122 so as to form eight corresponding radially intermediate channels 158. This is best seen in FIGS. 8, 11 and 12. The radially intermediate channels 158 open into a second annular space 160 formed between, on one side, the frusto-conical portion 114 and part of the first cylindrical portion 112 of the inner surface of the outer annular insert 88 and, on the other side, the curved portion 98*a* and part of the second cylindrical portion 100*a* of the outer surface of the inner annular insert 122. At the end of the second annular space 160 which is closest to the outlet end 62 of the nozzle 29, the second annular space 160 opens into a second annular passageway 162 which extends between the second cylindrical portion 116 of the inner surface of the outer annular insert 88 and the second cylindrical portion 100*a* of the outer surface of the inner annular insert 122. At the outlet end 62, the second annular passageway 162 opens into a droplet directing formation consisting of the frusto-conical surface 126 of the annular flange 124 on the inner annular insert 122 and the annular wall 102 including the forwardly directed annular rib 104 on the outer annular insert 88. As seen in FIG. 12, the frusto-conical surface 126 is located axially outwardly of the annular wall 102. This droplet directing formation directs droplets from the outlet end 62 of the nozzle 29 at an acute angle to the axis 107.

The flange portion 132 of the surface of the inner insert 128 fits within the recess portion 108*a* of the inner surface of the inner annular insert 122 so as to locate the inner insert 128 within the inner annular insert 122. The first cylindrical portion 136 of the surface of the inner insert 128 lies closely within the first cylindrical portion 112*a* of the inner surface of the inner annular insert 122 so that the inner surface of the inner annular insert 122 closes the grooves 144 provided in the inner insert 128. The six grooves 144 when closed in this way form six corresponding radially inner channels 164, which are best seen in FIGS. 8, 11 and 12. The radially inner channels 164 open into a third annular space 166 which is formed generally between, on one side, the frusto-conical portion 114*a* and part of the first cylindrical portion 112*a* of the inner surface of the inner annular insert 122 and, on the other side, the curved portion 138 of the inner insert 128. The third annular space 166 opens into a cylindrical passageway 168 which is formed by the second cylindrical portion 116*a* of the inner surface of the inner annular insert 122, and which leads to the outlet end 62 of the large nozzle 29.

One of the small nozzles 32*a* is shown in FIG. 17. The small nozzles 32*a*, 32*b*, 32*c*, 32*d* are identical to one another and similar to the large nozzle 29. Referring to FIG. 17, each small nozzle 32*a*, 32*b*, 32*c*, 32*d* has an inlet end 170 and an outlet end 172. Each small nozzle 32*a*, 32*b*, 32*c*, 32*d* also has a narrow portion 174 located at the inlet end 170, then narrow portion 174 being provided with an external thread 176 so as to allow the small nozzle to be threadably mounted in one of the four small outlets mounts 44*a*, 44*b*, 44*c*, 44*d*. Each small nozzle 32*a*, 32*b*, 32*c*, 32*d* has a casing 178 which is similar to the casing 72 of the large nozzle 29, an outer annular insert 180 which is similar to the outer annular insert 88 of the large nozzle 29, an inner annular insert 182 which is similar to the inner annular insert 122 of the large nozzle 29 and an inner insert 184 which is similar to the inner insert 128 of the large nozzle 29. These four component parts 178, 180, 182, 184 of each small nozzle 32*a*, 32*b*, 32*c*, 32*d* are concentric with one another and are not described in detail in view of their similarity to the corresponding parts of the large nozzle 29. It is noted, however, that the inner surface of the casing 178 has a frusto-conical portion 186 replacing the curved portion 82 and the second cylindrical portion 84 of the inner surface of the casing 72.

In operation, when the control unit 14 passes an activating signal to the extinguisher unit 20, the extinguisher unit 20 causes the valves to open between the discharge heads 26 and the liquid containers 24. The processes that take place in the discharge heads 26 are identical and so this process will only be described with reference to one of the discharge heads 26.

Before activation, the chamber 38 is already full of air. When the valve between the discharge head 26 and the corresponding liquid container 24 is opened, the pressurized gas 48 in the liquid container 24 forces the liquid 46 through the inlet 40 to the chamber 38 of the discharge chamber body 28. The speed at which the liquid 46 is introduced into the chamber 38 is preferably very fast, and may be in the order of 500 litres per second.

Liquid 46 entering the chamber 38 via the inlet 40 impinges first on the convex surface 36 of the first wall 30. As the liquid impinges against the convex surface 36, the liquid is directed by the convex surface 36 in a plurality of directions around the chamber 38, including towards the large nozzle 29. The shape of the chamber 38, and in particular the shape of the convex surface 36 of the first wall 30 is such so as to maximise turbulence within the chamber 38. Turbulence is also increased by the roughness of the convex surface 36 and the concave surface 37. The result of the turbulence is that the air already contained within the chamber 38 before introduction of the liquid 46 is commenced, is very rapidly and thoroughly entrained into the liquid 46 entering the chamber 38.

In view of this rapid entrainment of the air into the liquid 46, the air is not pushed on its own through the nozzles 29, 32*a* to 32*d*. Instead, the mixture of air and liquid 46—the air being entrained within the liquid 46—is discharged almost immediately through the nozzles 29, 32*a* to 32*d*.

Figure 5:
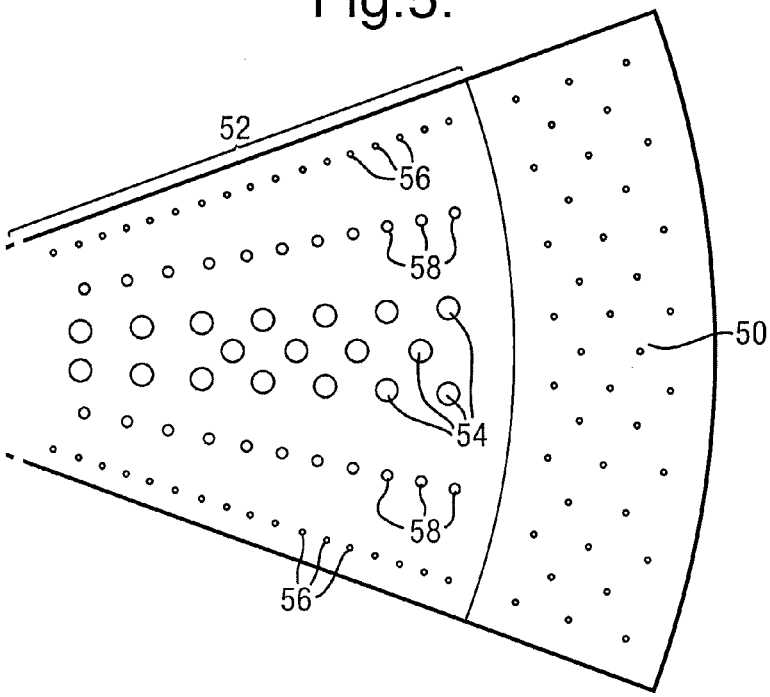
FIG. 5 is a schematic representation of a conical discharge from a nozzle of the discharge head shown in FIGS. 2 and 3.

When the mixture of the liquid 46 and the air is discharged through the nozzles 29, 32*a* to 32*d*, the nozzles produce a mist consisting of small water droplets which are relatively homogenous in size and distribution. This fine mist, shown at 50 in FIG. 5, is very effective at suppressing explosions. Each nozzle 29, 32*a*-32*d* discharges the mist in a conical discharge shape.

After all the air which was originally contained within the chamber 38 before introduction of the liquid 46 has been discharged from the discharge head 26, there is no gas left within the chamber 38. At this stage, liquid 46 is still being forced into the chamber 38 and the liquid 46 is discharged from the nozzles 29, 32*a* to 32*d* in the form of a conical spray of liquid droplets. This is shown at 52 in FIG. 5. As shown in FIG. 5, the cone of liquid droplets consists of relatively large droplets 54 at the axial centre of the cone, relatively small droplets 56 at the outside of the cone, and intermediate size droplets 58 between the axial centre and the outside of the cone.

The way in which each nozzle 29, 32*a*-32*d* produces, from liquid alone (after the gas has been discharged from the chamber 38), a conical spray with larger droplets 54 at the axis of the cone, smaller droplets 56 at the outside of the cone, and intermediate sized droplets 58 between the larger and smaller droplets is now described. This process will be described for the large nozzle 29 only, as the process is substantially identical in each of the small nozzles 32*a*-32*d*.

Referring to FIGS. 11 and 12, the liquid enters the nozzle 29 at the inlet end 60 passing into the radially outer channels 150, the radially intermediate channels 158 and the radially inner channels 164. Liquid which enters the radially outer channels 150 eventually forms the smaller droplets 56 at the outside of the conical spray. As the liquid passes through the radially outer channels 150, the generally spiral curvature of the radially outer channels 150 imparts a rotational momentum to the liquid. As the liquid exits the radially outer channels 150 into the first annular space 152, the liquid is moving in both an axial direction and also rotationally around the axis 107. In view of the shape of the first annular space 152, as the liquid progresses through the first annular 152 it is forced to move radially inwardly, and this causes an increase in the speed of rotation of the liquid. The liquid then passes through the first annular passageway 156 into the droplet directing formation formed by the annular wall 102 and the outwardly facing concave surface 86. This droplet directing formation directs the relatively small droplets 56 outwardly from the outlet end of the nozzle 29 at an angle of about 60° from the axis 107.

FIG. 18 is a photograph taken after 32 milliseconds from initiation of discharge of liquid alone through the large nozzle 29. The photograph shows conical discharge of liquid droplets and it is possible to see an outer portion 190 of the spray which consists of the smaller droplets 56.

The liquid which enters the radially intermediate channels 158 eventually forms the intermediate sized droplets 58 in the spray. This liquid passes through the intermediate channels 158 gaining rotational momentum in view of the generally spiral curvature of the intermediate channels 158. This liquid exits the radially intermediate channels 158 into the second annular space 160 formed between the outer and inner annular inserts 88, 122. Again, the shape of the second annular space 160 forces the liquid to move radially inwardly and this increases the rotational velocity of the liquid. The liquid then passes into the second annular passageway 162 to the droplet directing formation formed by the frusto-conical surface 126 and the annular wall 102. This droplet directing formation directs the intermediate size droplets 58 outwardly from the outlet end 62 of the nozzle 29 through a range of angles extending from about 30 to 50° from the axis 107. This portion of the conical spray is seen at 192 in FIG. 18.

The liquid that enters the radially inner channels 164 forms the core of relatively large droplets 54. Again, as this liquid passes through the radially inner channels 164, it acquires a rotational momentum from the generally spiral curvature of the radially inner channels 164. As the liquid exits the radially inner channels 164 it enters the third annular space 166 which, again, directs the liquid radially inwardly thereby increasing the rotational speed of the liquid. From the third annular space 166, the liquid passes into the cylindrical passageway 168 from which it is discharged at the outlet end 62 of the nozzle 29. The liquid which is discharged from the cylindrical passageway 168 forms an inner component of the conical spray consisting of the smallest droplets 54. This inner component extends to about 20° from the axis 107. This component is shown at 194 in FIG. 18.

As will be appreciated from the description of the spiral grooves 106, 106*a* and 144 above, the radially outer channels 150 have the smallest depth in the radial direction, the radially inner channels 164 have the greatest depth in the radial direction, and the intermediate channels 158 have an intermediate depth in the radial direction. It has been found that the depth of the channels in the radial direction is related to droplet size in that deep channels produce large droplets and shallow channels produce smaller droplets.

It will also be appreciated from the discussion of the grooves 106, 106*a* and 144 above, that the generally spiral curvatures of the channels 150, 158, 164 differ from one another. Specifically, at the ends of the channels 150, 158, 164 that open into the corresponding annular spaces 156, 160, 166, the radially outer channels 150 undergo a greater angular extension around the axis 107 for a given unit length in the axial direction as compared to the radially inner channels 164. The radially intermediate channels 158 undergo an intermediate angular extension around the axis 107 for the same unit distance along the axis 107. In other words, when comparing the angles of the channels 150, 158, 164 at their outlets, the radially outer channels 150 have a greater angle relative to the axis 107, the radially intermediate channels 158 have an intermediate angle relative to the axis 107 and the radially inner channels 164 have a smaller angle relative to the axis 107. The greater the angular extension for a given unit length in the axial direction (in other words the greater the angle compared to the axis 107) the greater the rotational momentum that is given to the liquid passing through the channels. It has been found that a greater rotational momentum leads to the formation of smaller droplets.

Hence, it will be appreciated that the shallow depth and the relatively large angular momentum corresponding to the radially outer channels 150 help to produce the small droplets 56. The intermediate depth and the intermediate rotational momentum corresponding to the intermediate channels 158 help to produce the intermediate size of the droplets 58. The large depth and the relatively low angular momentum corresponding to the radially inner channels 164 help to generate the large droplets 54 at the core of the conical spray 52.

Droplet size is also affected by roughness of the surfaces of the channels. The rougher the surface the greater the turbulence and the smaller the droplets.

The nozzles 29, 32*a*-32*d* are constructed to withstand relatively high pressures. During discharge, the pressures experienced by the chamber and the nozzles may be in the region of 20-60 bar, preferably 40-60 bar.

The channels 150, 158, 164 through the nozzles 29, 30*a*-30*d* have no sharp bends and this helps to maximise liquid flow rate through the nozzles 29, 30*a*-30*d*.

As will be appreciated from FIGS. 5 and 18, the whole of the discharge from each nozzle 29, 32*a* to 32*d*, is generally in the form of a cone—with the fine mist 50 proceeding the region 52 consisting of large, intermediate and small droplets. The nozzles 29, 32*a* to 32*d* are spaced around the spherical first wall 29 so that, with a view to the size and cone angles of the conical discharges, the five nozzles 29, 32*a* to 32*d* produce, as far as possible, a large generally uninterrupted area of spray. In order to achieve this, the conical discharges from the different nozzles overlap to some extent so as to leave virtually no spaces therebetween.

It will be appreciated that the discharge head 26 described above gives rise to very significant advantages. Firstly, as the shape of the chamber 38 leads to rapid and thorough entrainment of the air within the liquid 46, this in turn leading to almost immediate discharge of a fine mist from the nozzles 29, 32*a* to 32*d*, the explosion suppressing system starts to suppress an explosion almost immediately. Additionally, there is almost no discharge of air alone from the discharge heads 26—discharge of air alone being disadvantageous by providing oxygen to the explosion. The explosion suppression system described above may discharge all of the liquid 46 and suppress an explosion within as little as 200 milliseconds.

Additionally, the droplet size distribution in the sprays, after the gas contained in the chamber 38 has been discharged, has been found to be highly advantageous, particularly in suppressing explosions. The large droplets 54 at the core of each spray have sufficient momentum to penetrate rapidly and deeply into a developing fireball (or a fire). The small droplets 56 at the outside of the spray are very effective at flooding an area—i.e. forming a generally homogenous uninterrupted mist which can completely fill an enclosed space. This helps both in suppressing an explosion (or a fire) and also in preventing re-ignition after a fireball (or a fire) has been extinguished. The intermediate sized droplets are optional and help with both functions.

In many cases, the liquid 46 might be pure water. However, other liquids may be used. For example, it is often desirable to use, as the liquid 46, an aqueous solution of an alkali salt. Aqueous solutions of alkali salts have been found to cool fires and explosions at higher rates as compared to pure water. Suitable alkali salts are potassium bicarbonate and potassium acetate. A particularly advantageous liquid is an aqueous solution of potassium lactate. The potassium lactate depresses the freezing point of the water, and the potassium lactate solution can remain a liquid at as low as minus 40° C. It is clearly advantageous to discharge a mist at a low temperature as this will tend to be more effective in suppressing explosions or extinguishing fires.

Non-aqueous liquids can also be used. Any non-aqueous liquid suitable for fire or explosion suppression may be used. For example, the liquid may be $CF_3CF_2C(O)CF(CF_3)_2$ which is sold under the trade mark NOVEC 1230 by 3M Corporation.

Preferably, liquids used in the explosion suppression system described above will have a boiling point in the range of 20° C.-100° C. Of particular interest are fire or explosion suppressing liquids having a boiling point in the range of 20° C.-60° C., more particularly in the range 20° C.-40° C.

The nozzles described above may be particularly advantageous for discharging non-aqueous fire or explosion suppressing liquids having boiling points in the range of 20° C.-100° C., and more particularly 20° C.-60° C. or 20° C.-40° C. One specific liquid that can be discharged from nozzles of the type described above is the aforementioned $CF_3CF_2C(O)CF(CF_3)_2$.

It will be appreciated that the explosion suppression system described above can be modified in a large number of ways.

Firstly, instead of being used to suppress an explosion, the system may be used, possibly with lower discharge rates, to extinguish fires. In this case the discharge pressures may be in the range of 4 to 12 bar.

The discharge chamber body 28 need not be exactly as described above. The chamber 38 may be any shape which increases turbulence as the liquid 46 is introduced into the chamber 38 so as to cause entrainment of air into the liquid 46.

While it is advantageous for the convex surface 36 of the first wall 30 to be spherical, other convex shapes may be used, such as elipsoid shapes. Similarly, other concave shapes, such as elipsoid shapes, may be used for the concave surface 37 of the second wall 32.

It is not necessary for the first wall 30 to be angled in relation to the inlet 44 by the precise angle shown in FIG. 4. Preferably, however, the direction of liquid introduction into the chamber 38 will be such so that the direction impinges on the convex surface 36 of the first wall 30 at an acute angle to a plane lying tangential to the convex outer surface 36 and touching the convex surface 36 at the point of contact between the direction of introduction and the convex surface 36.

It will be appreciated that any suitable number of nozzles may be used. Additionally, whereas it is preferred to use a nozzle or nozzles which, after the air has been exhausted from the chamber 38, produce a conical discharge with course droplets at the centre and fine droplets at the outside, this is not essential. Any suitable nozzles may be used. The combination of the discharge body 28 and the nozzles 29, 30*a*-30*d* has been found to be particularly effective in suppressing explosions.

Other nozzles which produce sprays with larger droplets at the inside and smaller droplets at the outside may also be used.

The extinguishers 22 may be connected to any suitable control unit and any suitable explosion or fire sensors may be used.

EXAMPLE

Tests carried out have demonstrated that the explosion suppression system described above is very effective at suppressing an explosion.

An explosion was simulated in a closed space having a volume of 6.9 $m^3$. The explosion was simulated using 1.1 l diesel fuel at a temperature of 82° C. and a pressure of 82.7 bar (g). The diesel fuel was discharged into the closed space through a TACOM fuel dispersion nozzle and ignited using a 5 KJ pyrotechnic igniter after 90 ms of initiation of the discharge.

The explosion suspension system was as described above and had the following specific characteristics. Three extinguishers 22 were spaced evenly in the close space. The pressure in the liquid containers 24 was 50 bar (g). Various amounts of liquid were used in different tests and the liquid was an aqueous solution of 50% (wt/vol) potassium lactate. Introduction of the liquid into the discharge heads 26 was initiated after 11 ms from ignition of the diesel fuel.

The closed space contained four human sized mannequins each fitted with a temperature sensors.

The results using the suppression system are shown in FIGS. 6*a* and 7*a* and comparative tests in which the explosion suppression system was not activated while identical explosions were simulated are shown in FIGS. 6*b* and 7*b*.

As seen by comparing FIGS. 6*a* and 6*b*, the explosion suppression system when operated kept the pressure within the closed space at less than 0.09 bar (g) (see FIG. 6*a*). When the suppression system was not operated, the pressure went up to 0.25 bar (g) during the simulated explosion (see FIG. 6*b*). The pressure within the space is shown by the lines A in FIGS. 6*a* and 6*b*.

As seen by comparing FIGS. 7*a* and 7*b*, when the explosion was simulated and the suppression system operated, the temperature was maintained below 50° C., as measured by the sensors on the mannequins (see FIG. 7*a*). As shown in FIG. 7*b*, when an identical explosion was simulated without operation of the suppression system, the temperature went up to over 800° C. The temperatures at the four mannequins are shown by lines D to G, respectively.

Tests showed that a liquid volume of 0.91 l per $m^3$ of closed space successfully suppressed the simulated explosion. Lower volumes could also be effective (down to 0.68 $l/m^3$) if the stored energy within the suppression system was above 40 $bar \cdot l \cdot kg^{-1}$.

What is claimed is:

1. A nozzle for producing a spray of liquid, the spray having a core of larger liquid droplets and the core being surrounded by smaller liquid droplets, wherein the nozzle has an axis, the nozzle having at least one first channel for carrying liquid which produces the core of larger liquid droplets, and at least one second channel for carrying liquid which produces the smaller liquid droplets, wherein the first channel has a greater depth in the radial direction than the second channel, and wherein each channel is curved about the axis and extends simultaneously angularly around the axis and in an axial direction toward an outlet end of the nozzle, wherein the nozzle has an inlet end and an outlet end, there being a plurality of second channels, the second channels opening into an annular space concentric with the axis, the annular space extending in an axial direction towards the outlet end of the nozzle from the second channels to an outlet of the annular space, the annular space lying between and being defined by a radially outer surface and a radially inner surface, and wherein each of the radially outer and radially inner surfaces lies closer to the axis in a radial direction at the outlet of the annular space than at the outlets of the second channels.

2. A nozzle according to claim 1, wherein the spray has a conical shape with the larger liquid droplets at the cone axis and the smaller liquid droplets at the outside of the cone.

3. A nozzle according to claim 1, wherein there are intermediate sized droplets in the spray between the larger droplets and the smaller droplets.

4. A nozzle according to claim 3, wherein the nozzle has at least one third channel for carrying liquid which produces the intermediate sized droplets.

5. A nozzle according to claim 4, wherein the third channel has a depth in the radial direction which is intermediate the radial depth of the first channel and the radial depth of the or each second channel.

6. A nozzle according to claim 1, wherein each channel has an inlet and an outlet, each channel being shaped so that the angular extension of the channel around the axis for a given unit length in the axial direction is greater at the channel outlet as compared to the channel inlet.

7. A nozzle according to claim 6, wherein each channel is shaped so that the angular extension of the channel around the axis for a given unit length in the axial direction increases progressively from the channel inlet to the channel outlet.

8. A nozzle according to claim 6, wherein the angular extension around the axis for a given unit length in the axial direction at the corresponding channel outlet is greater for the second channel than for the first channel.

9. A nozzle according to claim 1, wherein the at least one first channel is located radially inwardly of the at least one second channel.

10. A nozzle according to claim 1, wherein there is a smaller droplet directing formation located at the outlet end of the nozzle, the smaller droplet directing formation being in fluid communication with the annular space for receiving liquid which has passed through the second channels and the annular space, the smaller droplet directing formation having an axially inwardly facing radially extending surface and a generally axially outwardly facing directing surface, the axially inwardly facing radially extending surface lying generally radially inwardly of the directing surface, the arrangement being such that liquid from the annular space is directed between the axially inwardly facing radially extending surface and a generally axially outwardly facing directing surface to direct the smaller droplets at a predetermined angle to the axis.

11. A nozzle according to claim 1, wherein there are a plurality of first channels, the first channels opening into a further annular space concentric with the axis, the further annular space extending in an axial direction towards the outlet end of the nozzle from the first channels to an outlet of the further annular space, the further annular space lying between and being defined by a radially outer surface and a radially inner surface.

12. A nozzle according to claim 11, wherein the further annular space is in fluid communication with an outlet passage which extends along the axis to the outlet end of the nozzle.

13. A nozzle according to claim 12, wherein the radially outer surface which borders the further annular space lies radially outwardly of the outlet passage.

14. A nozzle according to claim 1, wherein the nozzle is formed from a plurality of concentric members, the first channel being formed between a first pair of the members and the second channel being formed between a second pair of the members.

15. A nozzle according to claim 1, wherein there are a plurality of first channels.

16. A nozzle according to claim 15, wherein there are intermediate sized droplets in the spray between the larger droplets and the smaller droplets, wherein the nozzle has a plurality of third channels for carrying the liquid which produces the intermediate sized droplets, wherein each third channel is curved and extends simultaneously angularly around the axis and in an axial direction toward the outlet end of the nozzle.

* * * * *